US007870954B2

(12) United States Patent
Quartarone, III

(10) Patent No.: US 7,870,954 B2
(45) Date of Patent: Jan. 18, 2011

(54) GOLF BAG WITH CIRCUMFERENTIAL STAY

(75) Inventor: Frank A. Quartarone, III, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 165 days.

(21) Appl. No.: 11/848,904

(22) Filed: Aug. 31, 2007

(65) Prior Publication Data

US 2008/0164166 A1 Jul. 10, 2008

Related U.S. Application Data

(60) Provisional application No. 60/884,264, filed on Jan. 10, 2007.

(51) Int. Cl.
*A63B 55/06* (2006.01)

(52) U.S. Cl. ..... 206/315.7; 206/315.3; 206/315.8; 248/96

(58) Field of Classification Search ..... 206/315.7, 206/315.8, 315.3; 248/96
See application file for complete search history.

(56) References Cited

U.S. PATENT DOCUMENTS

| | | | | |
|---|---|---|---|---|
| 1,128,921 | A * | 2/1915 | Wadsworth | 206/315.8 |
| 1,181,007 | A * | 4/1916 | Henneberg | 248/96 |
| 1,357,590 | A * | 11/1920 | Pierce | 206/315.8 |
| 2,006,920 | A * | 7/1935 | Hotze | 224/613 |
| 2,006,921 | A * | 7/1935 | Hotze | 224/613 |
| 2,079,551 | A * | 5/1937 | Eicholtz | 206/315.8 |
| 2,435,479 | A | 8/1944 | Thommen | |
| 2,507,249 | A * | 5/1950 | Dorazio | 206/315.8 |
| 2,599,635 | A * | 6/1952 | Hotze | 206/315.8 |
| 2,628,801 | A * | 2/1953 | Gunning | 248/96 |
| 2,704,562 | A * | 3/1955 | Gordon | 206/315.8 |
| 3,331,420 | A * | 7/1967 | Wilkens | 206/315.8 |
| 4,739,958 | A * | 4/1988 | Sato | 248/96 |
| 4,796,752 | A * | 1/1989 | Reimers | 206/315.3 |
| 4,798,357 | A * | 1/1989 | Cho | 248/96 |
| 4,834,235 | A | 5/1989 | Solheim et al. | |
| 5,607,128 | A * | 3/1997 | Suk | 248/96 |
| 5,829,719 | A * | 11/1998 | Han | 248/96 |
| 5,996,789 | A * | 12/1999 | Suggs et al. | 206/315.3 |
| 6,415,919 | B1 | 7/2002 | Keller | |
| 2005/0045504 | A1 | 3/2005 | Tan | |
| 2005/0092631 | A1 | 5/2005 | Campbell et al. | |
| 2007/0215500 | A1 | 9/2007 | Jung | |

FOREIGN PATENT DOCUMENTS

| | | | |
|---|---|---|---|
| CN | 2647367 | Y | 10/2004 |

* cited by examiner

*Primary Examiner*—Sue A Weaver

(57) ABSTRACT

A golf bag has a partially collapsible side and a bag stand mounted to the partially collapsible side of the bag. The action of the partially collapsible side of the bag collapsing causes the bag stand to deploy. A circumferential stay is mounted to the partially collapsible side of the golf bag to prevent the body of the bag from folding inward as the partially collapsible side collapses.

20 Claims, 1 Drawing Sheet

GOLF BAG WITH CIRCUMFERENTIAL STAY

This is a nonprovisional application claiming the benefit of provisional application No. 60/884,264 filed Jan. 10, 2007.

BACKGROUND OF THE INVENTION

This invention relates generally to golf equipment and, in particular, to golf bags.

Golf bags with stands are well known in the art. One popular golf bag with a stand is disclosed in U.S. Pat. No. 4,834,235 to Solheim et al. The golf bag disclosed in the Solheim patent comprises a lightweight fabric body with rigid members at the top and bottom ends. The rigid members are connected by a rigid spine that extends longitudinally of the body. Because the spine supports only one side of the body, the diametrically opposed side of the body remains at least partially collapsible. It is this characteristic that is employed to operate the golf bag stand which is mounted on the partially collapsible side of the body and includes a pair of legs. The upper ends of the legs are pivotally attached to the rigid member at the top end of the body. An actuator rod of generally U-shaped configuration is attached to the rigid member at the bottom end of the body so that the free ends of the actuator rod may be attached to the legs at points between the upper and lower ends of the legs.

Whenever the golf bag is in its normal position, i.e., in the form of a right circular cylinder, such as when being carried, the distance between the top and bottom ends of the body will be at a maximum. This causes the legs to be retracted and held firmly against the side of the body so that the legs do not interfere with any normal activities of the golfer carrying the golf bag.

When the golfer sets the golf bag down, the simple and natural movement of resting the bag on its bottom end and leaning it over slightly automatically moves the legs of the stand into an extended position as the partially collapsible side of the golf bag collapses. As the partially collapsible side of the body collapses, the pleats formed in the light weight fabric generally fold neatly and do not interfere with the contents of the golf bag, however, occasionally the pleats will fold inward and bind against the grips of the golf clubs carried in the golf bag, thereby making their removal inconvenient. Accordingly, it would be advantageous to provide a means of reinforcing the partially collapsible side of the body to prevent the pleats from folding inward while preserving the advantageous partially collapsible characteristics of the body.

SUMMARY OF THE INVENTION

The present invention comprises a golf bag with a body having a partially collapsible side. According to an illustrative embodiment of the invention, the golf bag comprises generally tubular shape with a top end, a bottom end and a rigid spine extending generally longitudinally of the body. A bag stand is mounted on a partially collapsible side of the body, which is diametrically opposite the spine. The action of the partially collapsible side of the body collapsing causes the bag stand to deploy. A circumferential stay is mounted on the partially collapsible side of the body to prevent the body from folding inward as its partially collapsible side collapses.

DESCRIPTION

Figure 1:
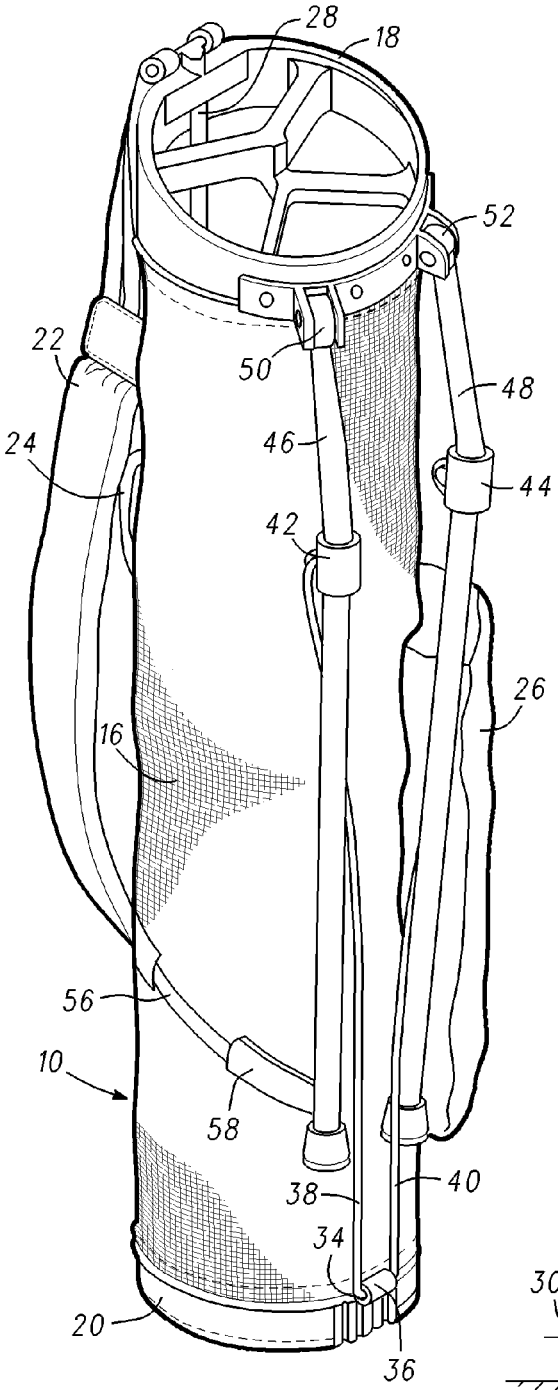
FIG. 1 is a perspective view of a golf bag incorporating features of the present invention.
Figure 2:
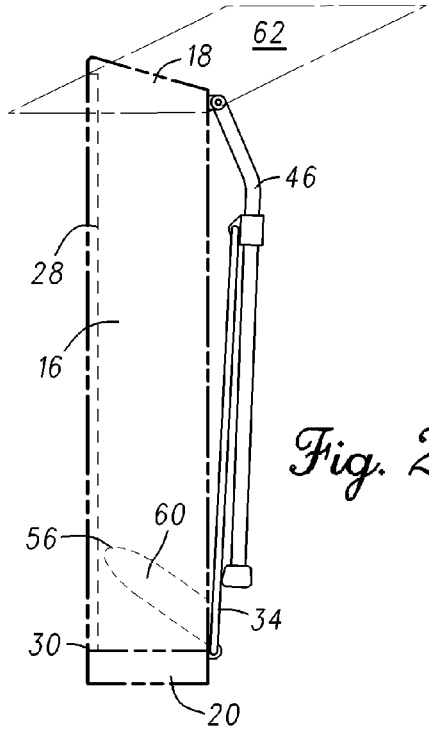
FIG. 2 is a diagrammatic view showing the golf bag of FIG. 1 with the stand in its retracted position.
Figure 3:
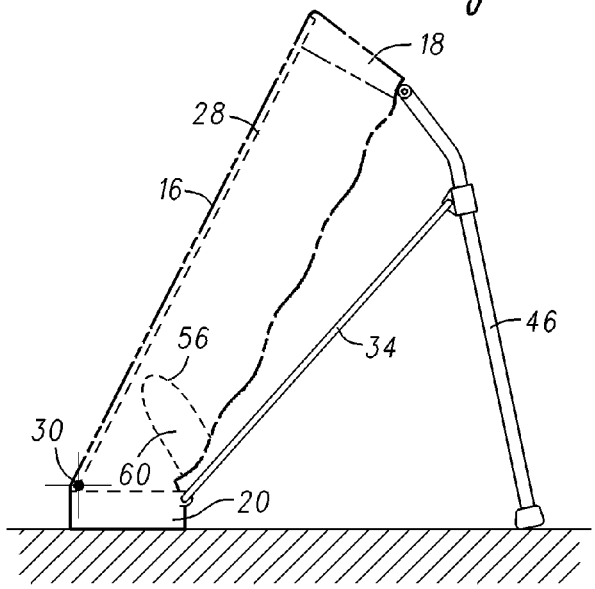
FIG. 3 is a diagrammatic view showing the golf bag of FIG. 1 with the stand in its extended position.

With reference to FIGS. 1-3, golf bag 10 comprises a tubular body 16 that is preferably formed of a lightweight fabric such as nylon. A ring-shaped member such as throat 18 is stitched or otherwise mounted to the top end of the body 16. Throat 18 is designed to segregate golf clubs into predetermined groups, with golf clubs being inserted into and removed from the golf bag 10 through the throat 18. A rigid bottom 20 is similarly mounted in the bottom end of the body 16. Both throat 18 and bottom 20 are preferably molded or otherwise formed of a suitable synthetic resin in a manner well known in the art. Golf bag 10 may also include various other features such as a shoulder strap 22, handle 24 and an accessory pocket 26. A generally rigid spine 28 formed by a primary stay interconnects throat 18 and bottom 20 to maintain throat 18 and bottom 20 in a spaced-apart relationship. Spine 28 may be made of wood, fiberglass or other suitable rigid lightweight material. Lower end 30 of spine 28 is hingedly attached to bottom 20 by means of a length of fabric, or other flexible material forming a fabric hinge, which permits bottom 20 to pivot relative to spine 28. As can be determined from the foregoing, because spine 28 extends along only one side of golf bag 10, the side of the body 16 diametrically opposite spine 28 is partially collapsible. Therefore, when resting on bottom 20, golf bag 10 will tend to collapse towards this collapsible side as shown in FIG. 3.

Golf bag 10 further includes a U-shaped actuator rod 34, the lower end of which is attached to a bearing 36 mounted on bottom 20. Actuator rod 34 has two upward extending arms 38 and 40. The upper ends of arms 38 and 40 are pivotally attached to collars 42 and 44 formed on legs 46 and 48. Legs 46 and 48 are themselves pivotally attached to bearings 50 and 52 mounted on throat 18.

Golf bag 10 further comprises a secondary circumferential stay 56 that exerts a radial force on body 16. Circumferential stay 56 preferably comprises an arcuate rod formed of resilient material such as spring steel or other resilient materials such as carbon fiber, fiberglass and other composite materials that are sufficiently rigid yet flexible enough to maintain the appropriate radial force on body 16. Circumferential stay 56 is preferably attached to body 16 by means of one or more batten pockets 58 formed on an exterior surface of body 16. This enables circumferential stay 56 to be attached to body 16 after it is assembled with throat 18 and bottom 20 and also permits circumferential stay 56 to be replaced in case of damage. In the illustrative embodiment, circumferential stay 56 comprises an arcuate rod extending at least 180 degrees of arc and preferably at least 270 degrees of arc around the circumference of body 16 (when viewed along spine 28). Circumferential stay 56 lies in a plane 60 that is oblique to radial plane 62, which itself lies perpendicular to the axis of spine 28.

When golf bag 10 is in a position shown in FIG. 2, as it will be when it is being carried or held in an upright position, the golf bag 10 will be generally cylindrical in shape. In such a state, the action of bottom 20 acting on legs 46 and 48 through actuator rod 34 will cause legs 46 and 48 to fold against the side of body 16 and thus be held out of the way. Simultaneously, the parallel, spaced-apart orientation of throat 18 and bottom 20 will hold the body 16 in a generally cylindrical configuration. When golf bag 10 is placed on the ground and tilted slightly forward, the collapsible portion of body 16 collapses to deploy the legs 46, 48. Because of circumferential stay 56 provides a radially outward force to body 16, however, body 16 does not form inwardly extending pleats that could interfere with the contents of golf bag 10. Instead, the collapsible portion of body 16 collapses outward and away from the contents of golf bag 10 thereby facilitating their easy removal when the golf bag 10 is in its partially collapsed state.

Although certain illustrative embodiments and methods have been disclosed herein, it will be apparent from the foregoing disclosure to those skilled in the art that variations and modifications of such embodiments and methods may be made without departing from the spirit and scope of the invention. For example, a non-planar circumferential stay comprising a partially folded loop (e.g., potato chip shaped) stay surrounding the lower ball pocket or a partially folded U-shaped stay partially surrounding the ball pocket or other flexible stay that provides a radial force to prevent the partially collapsible side of bag 10 from folding inwards could be advantageously used and, therefore, is considered within the scope of the present invention. Accordingly, it is intended that the invention should be limited only to extent required by the appended claims and the rules and principals of applicable law.

What is claimed is:

1. A golf bag comprising:

a body having a generally tubular shape with a top end, a bottom end and a generally rigid spine extending substantially longitudinally of said body between said top end and said bottom end, said rigid spine defining a radial plane normal thereto, said body further comprising a partially collapsible side opposite said spine;

an automatically extensible stand mounted on the partially collapsible side of said body, said automatically extensible bag stand comprising at least one leg member pivotally connected to said body proximal said top end and an actuator rod, said actuator rod having a lower end coupled to said bottom end of said body and an upper end coupled to an intermediate portion of said leg member, said actuator rod operating to deploy said at least one leg member as said partially collapsible side of said body collapses; and a circumferential stay attached to said body without a rigid attachment between said circumferential stay and said bottom end, said circumferential stay comprising a ring-shaped portion, said ring-shaped portion lying in a plane intersecting said radial plane at an oblique angle and extending along an arcuate length at least 180 degrees of arc but less than the full circumference of said body, said circumferential stay exerting a radial force to prevent said body from collapsing radially inward as said collapsible side of said body collapses.

2. The golf bag of claim 1, wherein said circumferential stay is held in a pocket formed on an exterior surface of said body.

3. The golf bag of claim 1, wherein said circumferential stay comprises an arcuate rod formed of a resilient material.

4. The golf bag of claim 3, wherein said arcuate rod is formed of spring steel.

5. The golf bag of claim 1, wherein:

said ring-shaped portion has a region proximal said spine and a region distal of said spine, the region proximal said spine being nearer the top end than the region distal of said spine.

6. A golf bag comprising:

a body having a top end, a bottom end and a primary stay extending substantially longitudinally of said body between said top end and said bottom end, said body further comprising a partially collapsible side opposite said primary stay;

an extensible stand mounted on the partially collapsible side of said body, said extensible bag stand comprising at least one leg member pivotally connected to said body proximal said top end and an actuator rod, said actuator rod having a lower end coupled to said bottom end of said body and an upper end coupled to an intermediate portion of said leg member, said actuator rod operating to deploy said at least one leg member as said partially collapsible side of said body collapses; and a secondary stay attached to said body without a rigid attachment between said secondary stay and said bottom end, said secondary stay comprising a ring-shaped member lying in a plane that intersects said primary stay at an oblique angle such that a first portion of said secondary stay proximal to said primary stay is nearer to the top end of said body than a second portion of said secondary stay that is more distant from said primary stay, said secondary stay extending along an arcuate path at least 180 degrees of arc but less than the full circumference of said body.

7. The golf bag of claim 6, wherein said secondary stay comprises an arcuate member located proximal said bottom end of said body.

8. The golf bag of claim 6, wherein said secondary stay is held in a pocket formed on an exterior surface of said body.

9. The golf bag of claim 6, wherein said secondary stay comprises an arcuate rod formed of a resilient material.

10. The golf bag of claim 9, wherein said arcuate rod is formed of spring steel.

11. The golf hag of claim 6, wherein:

said body has an interior cavity that extends substantially the full length of said body such that the bottom end of said body remains parallel to a supporting surface as said bag is moved from an upright to a tilted forward position.

12. A golf bag comprising:

a body having a generally tubular shape with a top end, a bottom end and a generally rigid spine disposed substantially longitudinally of said body between said top end and said bottom end so that a diametrically opposed side of said body is partially collapsible; and a circumferential stay attached to said body proximal to and spaced apart from said bottom end, said circumferential stay comprising a planar, ring-shaped element extending along an arcuate length at least 180 degrees of arc but less than the full circumference of said body, said circumferential stay exerting a radial force to prevent said body from collapsing radially inward as said partially collapsible side of said body collapses.

13. The golf bag of claim 12, wherein said circumferential stay is held in a pocket formed on an exterior surface of said body.

14. The golf bag of claim 12, wherein said circumferential stay comprises an arcuate rod formed of resilient material.

15. The golf bag of claim 14, wherein said arcuate rod is formed of spring steel.

16. The golf bag of claim 12, further comprising a stand mounted on said partially collapsible side of said body.

17. The golf bag of claim 16, wherein said stand comprises a leg pivotally connected at one end to said body.

18. The golf bag of claim 17, wherein said stand further comprises an actuator rod coupled between said body and said leg.

19. The golf bag of claim 18, wherein said actuator rod has a lower end coupled to said body and an upper end coupled to said leg in order to extend said leg away from body as said partially collapsible side of said body collapses.

20. The golf bag of claim 12, wherein:

said planar, ring-shaped element has a region proximal said spine and a region distal of said spine, the region proximal said spine being nearer the top end than the region distal of said spine.

* * * * *